US012600449B1

(12) United States Patent
Gable et al.

(10) Patent No.: US 12,600,449 B1
(45) Date of Patent: Apr. 14, 2026

(54) MARINE VESSELS HAVING A FIRST MARINE DRIVE AND A SECOND MARINE DRIVE AND METHODS FOR CONTROLLING THEM

(71) Applicant: Brunswick Corporation, Mettawa, IL (US)

(72) Inventors: Kenneth G. Gable, Oshkosh, WI (US); Conor A. Leehaug, Appleton, WI (US); Andres Perdomo Tornbaum, Neenah, WI (US)

(73) Assignee: Brunswick Corporation, Mettawa, IL (US)

( * ) Notice: Subject to any disclaimer, the term of this patent is extended or adjusted under 35 U.S.C. 154(b) by 566 days.

(21) Appl. No.: 18/315,323

(22) Filed: May 10, 2023

(51) Int. Cl.
*B63H 20/10* (2006.01)
*B63H 20/00* (2006.01)

(52) U.S. Cl.
CPC ..... *B63H 20/10* (2013.01); *B63H 20/007* (2013.01); *B63H 2020/003* (2013.01)

(58) Field of Classification Search
CPC .... B63H 20/10; B63H 20/007; B63H 20/003; B63H 25/02; B63H 25/42; B63H 2025/026; B63H 2025/425; B63H 2020/003; B63B 79/40
See application file for complete search history.

(56) References Cited

U.S. PATENT DOCUMENTS 4,294,186 A 10/1981 Wardell
5,131,875 A 7/1992 Lee
5,152,240 A 10/1992 Fontanille
6,142,841 A 11/2000 Alexander, Jr. et al.
6,280,267 B1 8/2001 Griffith et al.
6,454,620 B1 9/2002 Theisen et al.
6,583,728 B1 6/2003 Staerzl
6,592,412 B1 7/2003 Geil et al.
6,659,817 B1 12/2003 Anderson et al.
(Continued)

FOREIGN PATENT DOCUMENTS

CA 2979909 A1 8/2018
EP 1611007 B1 8/2007
(Continued)

OTHER PUBLICATIONS

"DockStar Smart Thruster" Operations Manual accessed from https://www.dockstarthrusters.com/_files/ugd/51fcc_1c9038fd74f2429b87c2d1845812af87.pdf on Mar. 13, 2023.
(Continued)

*Primary Examiner* — Stephen P Avila
(74) *Attorney, Agent, or Firm* — Andrus Intellectual Property Law, LLP

(57) ABSTRACT

A marine vessel configured to be situated in water. The marine vessel includes a first marine drive and a second marine drive each configured to propel the marine vessel in the water. A first actuator is configured to change a trim angle of the first marine drive in the water. A second actuator is configured to change a depth of the second marine drive in the water. A control system is operatively connected to the first actuator and the second actuator. The control system is configured to change the depth of the second marine drive via the second actuator based on the trim angle of the first marine drive to prevent damage to the second marine drive.

20 Claims, 6 Drawing Sheets

(56) References Cited

U.S. PATENT DOCUMENTS

| | | | |
|---|---|---|---|
| 6,857,917 | B1 | 2/2005 | Wasilewski |
| 7,004,803 | B2 | 2/2006 | Ruffe |
| 7,143,363 | B1 | 11/2006 | Gaynor et al. |
| 7,150,662 | B1 | 12/2006 | Janitz |
| 7,150,664 | B1 | 12/2006 | Uppgard et al. |
| 7,156,709 | B1 | 1/2007 | Staerzl et al. |
| 7,188,581 | B1 | 3/2007 | Davis et al. |
| 7,255,616 | B1 | 8/2007 | Caldwell |
| 7,294,031 | B1 | 11/2007 | Davis et al. |
| 7,370,599 | B1 | 5/2008 | Berman et al. |
| 7,381,108 | B1 | 6/2008 | Salmon |
| 7,398,742 | B1 | 7/2008 | Gonring |
| 7,416,456 | B1 | 8/2008 | Gonring et al. |
| 7,467,595 | B1 | 12/2008 | Lanyi et al. |
| 7,565,876 | B2 | 7/2009 | Wilson et al. |
| 7,765,946 | B1 | 8/2010 | Berman et al. |
| 7,867,046 | B1 | 1/2011 | Eichinger |
| 7,938,377 | B2 | 5/2011 | Dragici et al. |
| 7,942,711 | B1 | 5/2011 | Swan |
| 8,011,982 | B1 | 9/2011 | Baier et al. |
| 8,113,892 | B1 | 2/2012 | Gable et al. |
| 8,261,682 | B1 | 9/2012 | DeVito |
| 8,622,777 | B1 | 1/2014 | McNalley et al. |
| 8,657,638 | B1 | 2/2014 | Gonring |
| 8,818,587 | B1 | 8/2014 | Arbuckle et al. |
| 9,278,740 | B1 | 3/2016 | Andrasko et al. |
| 9,290,252 | B1 | 3/2016 | Tuchcherer et al. |
| 9,296,455 | B2 | 3/2016 | Bernloehr et al. |
| 9,334,034 | B1 | 5/2016 | Waldvogel et al. |
| 9,359,057 | B1 | 6/2016 | Andrasko et al. |
| 9,381,989 | B1 | 7/2016 | Poirier |
| 9,481,439 | B1 | 11/2016 | Groschel et al. |
| 9,517,825 | B1 | 12/2016 | Anschetz et al. |
| 9,598,160 | B2 | 3/2017 | Andrasko et al. |
| 9,623,948 | B1 | 4/2017 | Waldvogel et al. |
| 9,643,698 | B1 | 5/2017 | Andrasko et al. |
| 9,682,760 | B1 | 6/2017 | O'Brien et al. |
| 9,694,892 | B1 | 7/2017 | Anschuetz et al. |
| 9,701,383 | B1 | 7/2017 | Stuber et al. |
| 9,701,384 | B1 | 7/2017 | Belter |
| 9,738,364 | B2 | 8/2017 | Abney |
| 9,745,036 | B2 | 8/2017 | Andrasko et al. |
| 9,751,605 | B1 | 9/2017 | Anschuetz et al. |
| 9,764,810 | B1 | 9/2017 | Andrasko et al. |
| 9,771,137 | B1 | 9/2017 | Gable et al. |
| 9,776,699 | B1 | 10/2017 | Alby et al. |
| 9,802,688 | B1 | 10/2017 | Tuchscherer et al. |
| D804,431 | S | 12/2017 | Abellera et al. |
| 9,857,794 | B1 | 1/2018 | Jarrell et al. |
| 9,862,471 | B1 | 1/2018 | Taylor et al. |
| 9,896,174 | B1 | 2/2018 | Anschuetz |
| 9,919,781 | B1 | 3/2018 | Andrasko et al. |
| 9,937,984 | B2 | 4/2018 | Herrington et al. |
| 9,944,375 | B1 | 4/2018 | Martin et al. |
| 9,969,475 | B1 | 5/2018 | Waisanen |
| 10,000,267 | B1 | 6/2018 | Anschuetz |
| 10,011,339 | B2 | 7/2018 | Anschuetz |
| 10,054,956 | B1 | 8/2018 | Anschuetz et al. |
| 10,059,415 | B1 | 8/2018 | Anschuetz et al. |
| 10,094,321 | B1 | 10/2018 | Anschuetz et al. |
| 10,112,692 | B1 | 10/2018 | Anschuetz |
| 10,118,681 | B1 | 11/2018 | Andrasko et al. |
| 10,118,682 | B2 | 11/2018 | Anschuetz |
| 10,137,971 | B2 | 11/2018 | Andrasko et al. |
| 10,167,069 | B2 | 1/2019 | Houle et al. |
| 10,214,271 | B1 | 2/2019 | Gonring et al. |
| 10,214,273 | B1 | 2/2019 | Smith et al. |
| 10,227,108 | B2 | 3/2019 | Bostwick |
| 10,281,928 | B2 | 5/2019 | Behling et al. |
| 10,336,429 | B1 | 7/2019 | Amerling et al. |
| 10,351,221 | B1 | 7/2019 | Anschuetz et al. |
| 10,435,127 | B2 | 10/2019 | Suzuki et al. |
| 10,472,038 | B1 | 11/2019 | Walgren et al. |
| 10,494,967 | B1 | 12/2019 | Osthelder et al. |
| 10,518,856 | B2 | 12/2019 | Andrasko et al. |
| 10,518,858 | B1 | 12/2019 | Klawitter et al. |
| 10,577,068 | B1 | 3/2020 | Gonring et al. |
| 10,611,451 | B1 | 4/2020 | Andrasko et al. |
| 10,829,190 | B1 | 11/2020 | Pugh et al. |
| 10,981,637 | B1 | 4/2021 | Alby et al. |
| 11,046,407 | B2 | 6/2021 | Van Dyke |
| 11,072,408 | B1 | 7/2021 | Kurzynski et al. |
| 11,084,563 | B1 | 8/2021 | Pielow et al. |
| 11,097,824 | B1 | 8/2021 | Anderson |
| 11,572,146 | B2 | 2/2023 | Kraus et al. |
| 11,827,319 | B1 * | 11/2023 | Perdomo Tornbaum ..... B63B 79/40 |
| 12,428,122 | B1 * | 9/2025 | Perdomo Tornbaum ..... B63H 25/42 |
| 2008/0173227 | A1 | 7/2008 | Salmon |
| 2010/0136857 | A1 | 6/2010 | Goudsmit |
| 2014/0329422 | A1 | 11/2014 | Ito |
| 2016/0068247 | A1 | 3/2016 | Morvillo |
| 2018/0050781 | A1 | 2/2018 | Anschuetz |
| 2018/0335788 | A1 | 11/2018 | Behling et al. |
| 2019/0344869 | A1 | 11/2019 | Chan et al. |
| 2020/0156751 | A1 | 5/2020 | Skrzypchak |
| 2020/0290713 | A1 | 9/2020 | Mizutani |
| 2020/0361588 | A1 | 11/2020 | Morvillo |
| 2021/0200244 | A1 | 7/2021 | Karnick et al. |
| 2021/0237834 | A1 | 8/2021 | They |
| 2022/0266972 | A1 | 8/2022 | Novak et al. |
| 2023/0399092 | A1 | 12/2023 | Morvillo |

FOREIGN PATENT DOCUMENTS

| | | | |
|---|---|---|---|
| EP | 2242678 | B1 | 11/2015 |
| EP | 2246252 | B1 | 5/2019 |

OTHER PUBLICATIONS

Perdomo, Methods for a Marine Vessel With Primary and Auxiliary Propulsion Devices. Unpublished U.S. Appl. No. 16/984,617, filed Aug. 4, 2020.

Max Power, "Retractable Thrusters," web page, last visited Feb. 11, 2020, available at https://www.max-power.com/category/14-retractable-thrusters.

Lewmar, "Swing Thruster," Product and Installation Manual, 2013, Issue 1.

Sideshift, "Houseboat Thrusters," web page, last visited Feb. 11, 2020, available at https://sideshift.com/products/houseboat-thrusters/.

Dockstar, "Smart Thruster," Operations Manual, 2018, available at https://ff73590a-69f6-41f4-aeea-2c36215fc9e4.filesusr.com/ugd/d51fcc_bc562379e09d4841ae170997f737cd97.pdf.

* cited by examiner

MARINE VESSELS HAVING A FIRST MARINE DRIVE AND A SECOND MARINE DRIVE AND METHODS FOR CONTROLLING THEM

FIELD

The present disclosure generally relates to marine vessels having a first marine drive and a second marine drive and methods for controlling them.

BACKGROUND

The following are incorporated herein by reference in entirety.

U.S. Pat. No. 11,572,146 discloses a stowable propulsion system for a marine vessel. A base is configured to be coupled to the marine vessel. A shaft has a proximal end and a distal end with a length axis defined therebetween, where the shaft is pivotably coupled to the base and pivotable about a transverse axis between a stowed position and a deployed position, and where the distal end is closer to the marine vessel when in the stowed position than in the deployed position. A gearset is engaged between the shaft and the base, where the gearset rotates the shaft about the length axis when the shaft is pivoted between the stowed position and the deployed position. A propulsion device is coupled to the distal end of the shaft. The propulsion device is configured to propel the marine vessel in water when the shaft is in the deployed position.

U.S. Pat. Nos. 10,829,190; 10,059,415; 9,919,781; 9,694,892; 9,643,698; 9,517,825; 9,334,034; 9,290,252; 8,622,777; 7,942,711; 7,416,456; 7,156,709; and 6,454,620 generally disclose systems and methods for controlling trimmable marine drives.

U.S. Patent App. Pub. No. 2022/0266972 discloses a stowable propulsion device for a marine vessel. A base is configured to be coupled to the marine vessel. A propulsor is configured to propel the marine vessel in water. An arm pivotably couples the propulsor to the base to move the propulsor into and between a stowed position located proximate to the marine vessel and a deployed position located relatively distal from the marine vessel as compared to the stowed position. An actuator linkage includes a first link that is pivotably coupled to the base and a second link that pivotably couples the first link to the arm. An actuator pivots the actuator linkage to move the propulsor into and between the stowed position and the deployed position.

SUMMARY

This Summary is provided to introduce a selection of concepts that are further described below in the Detailed Description. This Summary is not intended to identify key or essential features of the claimed subject matter, nor is it intended to be used as an aid in limiting the scope of the claimed subject matter.

In one aspect of the present disclosure, a marine vessel is configured to be situated in water. The marine vessel includes a first marine drive and a second marine drive each configured to propel the marine vessel in the water. A first actuator is configured to change a trim angle of the first marine drive in the water. A second actuator is configured to change a depth of the second marine drive in the water. A control system is operatively connected to the first actuator and the second actuator. The control system is configured to change the depth of the second marine drive via the second actuator based on the trim angle of the first marine drive to prevent damage to the second marine drive.

In another aspect, the first marine drive includes at least one outboard motor and the second marine drive comprises a stowable thruster. In a further aspect, the first marine drive is positioned near a stern of the marine vessel and the second marine drive is positioned near a bow of the marine vessel.

In another aspect, the control system is operably connected to the first marine drive and the second marine drive, and the control system is configured to prevent the first marine drive and the second marine drive from simultaneously propelling the marine vessel.

In another aspect, the second actuator is configured to change the depth of the second marine drive to an upper position, a lower position that is deeper in the water than the upper position, and least one intermediate position therebetween. In a further aspect, the second marine drive is configured to propel the marine vessel in each of the lower position and the intermediate position. In a further aspect, the first actuator is configured to change the trim angle of the first marine drive to an upper position, a lower position, and an intermediate position therebetween.

In another aspect, the first actuator is configured to change the trim angle of the first marine drive to an upper position, a lower position, and an intermediate position therebetween, and the control system is configured to change the depth of the second marine drive based on the trim angle of the first marine drive only when the trim angle of the first marine drive is at or between the intermediate position and the upper position.

In another aspect, the control system is configured to receive a trim command from a user to change the trim angle of the first marine drive. In a further aspect, the control system is configured to receive a depth command from the user to change the depth of the second marine drive.

In another aspect, the second actuator pivots the second marine drive to change the depth thereof.

In another aspect, the depth of the second marine drive is changeable into and between an upper position that is out of the water and a lower position that is in the water.

In another aspect, the present disclosure relates to a method for changing via a control system a first marine drive and a second marine drive for a marine vessel configured to be situated in water, whereby a trim angle of the first marine drive is changeable and a depth of the second marine drive is changeable into and between an upper position and a lower position with intermediate positions therebetween. The method further includes receiving via the control system a trim command to increase the trim angle of the first marine drive, increasing the trim angle of the first marine drive based on the trim command, and decreasing a depth of the second marine drive to one of the intermediate positions based on the trim angle of the first marine drive so as to prevent damage to the second marine drive.

In another aspect, the method further includes operating the second marine drive while in the one of the intermediate positions to propel the marine vessel.

In another aspect, the method further includes comparing the trim angle of the first marine drive to a trim threshold and decreasing the depth of the second marine drive based on the trim angle of the first marine drive only when the trim angle is greater than the trim threshold. In a further aspect, the method further includes increasing the depth of the second marine drive when the trim angle of the first marine drive is less than the trim threshold after being greater than the trim threshold.

In another aspect, the trim command is a first trim command and the method further includes receiving a second trim command to decrease the trim angle of the first marine drive, decreasing the trim angle of the first marine drive based on the second trim command, and increasing the depth of the second marine drive based on the trim angle of the first marine drive.

In another aspect, the method further includes accessing a stored lookup table for changing the depth of the second marine drive based on the trim angle of the first marine drive when changing the depth of the second marine drive.

In another aspect, the trim angle of the first marine drive is changeable into and between an upper position and a lower position, and the method further includes changing the depth of the second marine drive to the upper position when the trim angle of the first marine drive is in the upper position.

In another aspect, the trim command is receivable from a user and the control system is further configured to receive a depth command for changing the depth of the second marine drive other than based on the trim angle of the first marine drive.

It should be recognized that the different aspects described throughout this disclosure may be combined in different manners, including those other than expressly disclosed in the provided examples, while still constituting an invention accord to the present disclosure.

Various other features, objects and advantages of the disclosure will be made apparent from the following description taken together with the drawings.

BRIEF DESCRIPTION OF THE DRAWINGS

The present disclosure is described with reference to the following Figures.

DETAILED DISCLOSURE

In the present description, certain terms have been used for brevity, clarity, and understanding. No unnecessary limitations are to be implied therefrom beyond the requirement of the prior art because such terms are used for descriptive purposes only and are intended to be broadly construed. The different systems and methods described herein may be used alone or in combination with other systems and methods. Various equivalents, alternatives, and modifications are possible.

Figure 1:
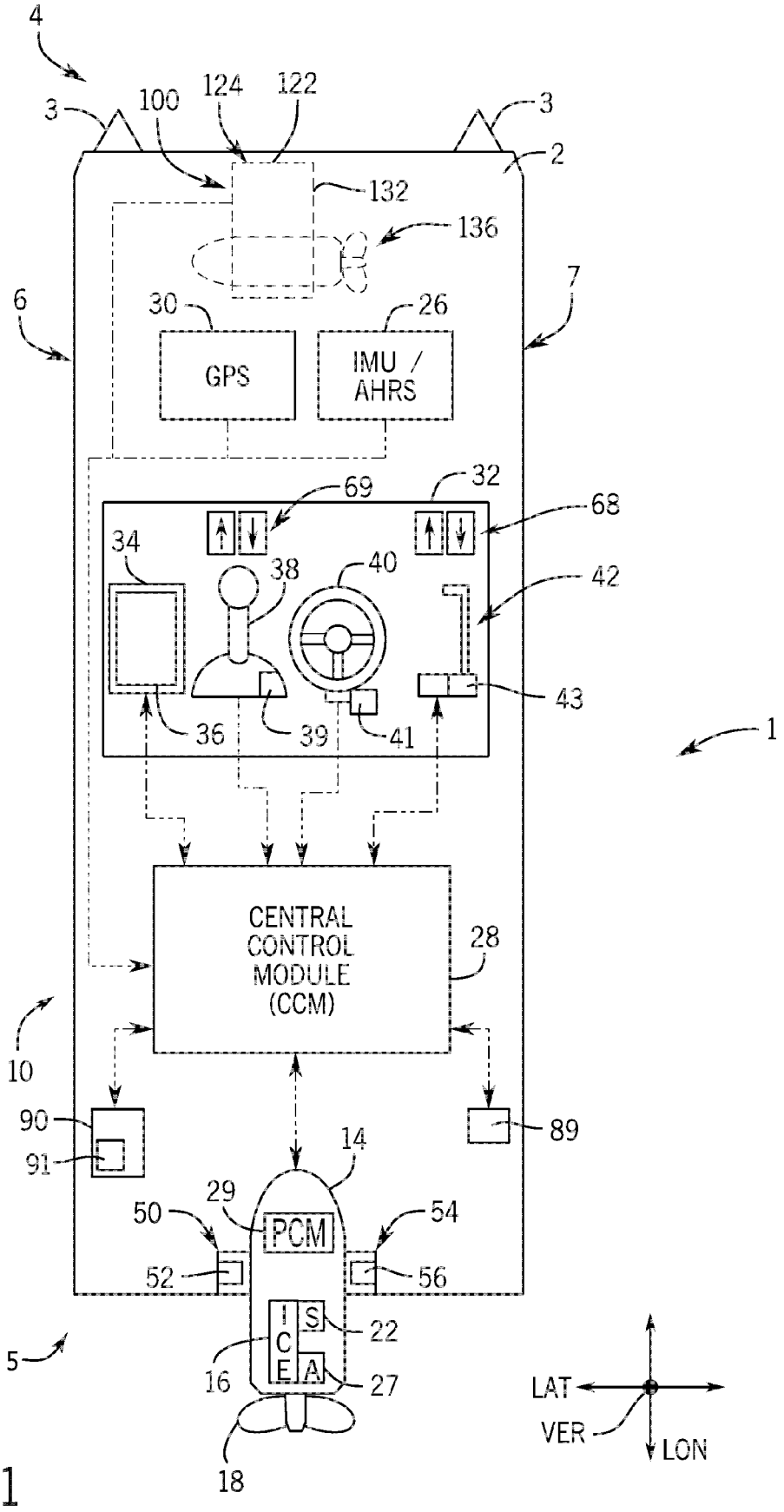
FIG. 1 is a top view of an exemplary marine vessel incorporating the systems and methods of the present disclosure.

FIG. 1 illustrates a system 10 for controlling marine drives, such as a first marine drive 14 and/or a second marine drive 100, each configured to propel a marine vessel 1 in the water in which the marine vessel 1 is situated. The marine vessel 1 is shown as a pontoon boat having a deck 2 supported by two or more pontoons 3 that provide float within the water. The marine vessel 1 extends along a longitudinal axis LON between a bow 4 and a stern 5, along a lateral axis LAT between a port side 6 side and starboard side 7, and along a vertical axis VER, wherein the longitudinal axis LON, the lateral axis LAT, and the vertical axis VER are each perpendicular to each other. For the illustrated marine vessel 1, the first marine drive 14 is an outboard motor positioned near the stern 5 of the marine vessel 1 and the second marine drive 100 is a stowable thruster provided near the bow 4 of the marine vessel 1 (e.g., part of Mercury Marine's Joystick Piloting for Outboards (JPO) system for single-engine pontoons). However, the locations, number, and types of the marine drives provided with the marine vessel 1 may vary from that shown, including having one or more inboard motors, stern drives, pod drives, and/or jet drives, the second marine drive 100 near the stern 5 along with the first marine drive 14, and other alternative combinations. The first marine drive 14 includes a powerhead 16, which may be internal combustion engine (e.g., gasoline or diesel engine), an electric motor, and/or a hybrid thereof. The first marine drive 14 in the illustrated example also includes a propeller 18 configured to be coupled in torque-transmitting relationship to the powerhead 16. The propeller 18 is rotated above a propeller shaft axis PSA to propel the marine vessel 1 in the water in a manner known in the art.

The first marine drive 14 further includes powerhead speed sensor 22 that measures a speed of the respective powerhead 16 or an output shaft thereof. In one example, the powerhead speed sensor 22 is a shaft rotational speed sensors (e.g., a Hall-Effect sensor) that measures a speed of the powerhead 16 in rotations per minute (RPM) in a manner known in the art.

A central control module 28 (or CCM 28) is provided in signal communication with the powerhead 16, as well as being in signal communication with the associated sensors and other components noted herein below. In certain examples, the central control module 28 communicates with a propulsion control module 29 (or PCM 29) and/or other control devices associated with the first marine drive 14 in a manner known in the art. Similar control is also provided for controlling the second marine drive 100, as discussed further below.

Power is provided to the marine vessel 1 via a power system 90, which in certain embodiments includes batteries 91 and/or other energy storage systems known in the art. The power system 90 provides power to the central control module 28 and propulsion control module 29, as well as to other components associated with the first marine drive 14 and the second marine drive 100 or marine vessel 1 more generally. Among the other components powered by the power system 90 is a steering actuator 50 that steers the first marine drive 14 in accordance with commands from a steering device as discussed further below. Exemplary steering actuators 50 are disclosed in U.S. Pat. Nos. 7,150,664; 7,255,616; and 7,467,595, which are incorporated by reference in entirety herein. By way of example, the steering actuator 50 may be a hydraulic actuator, a pneumatic actuator, an electromechanical actuator, or a hybrid thereof.

With continued reference to FIG. 1, the steering actuator 50 illustrated is a "steer-by-wire" system, whereby the steering actuator is controlled by electronic signals from the central control module 28 and/or the propulsion control module 29 rather than by physical linkages to steering devices, such as a joystick 38 and/or a steering wheel 40. Sensors 39, 41 associated with the steering devices detect the positions of these steering devices and provide electronic signals to the central control module 28 for subsequently steering the marine vessel 1 in a manner known in the art. A steering angle sensor 52 is also provided in conjunction with the steering actuator 50 to provide feedback regarding the steering angle of the first marine drive 14 at any given time in a manner known in the art. It will be recognized that the actual steering angle of the first marine drive 14 may be inferred based on the position of the steering actuator 50, for example whereby the steering angle sensor 52 is an encoder associated with the steering actuator 50.

Figure 2:
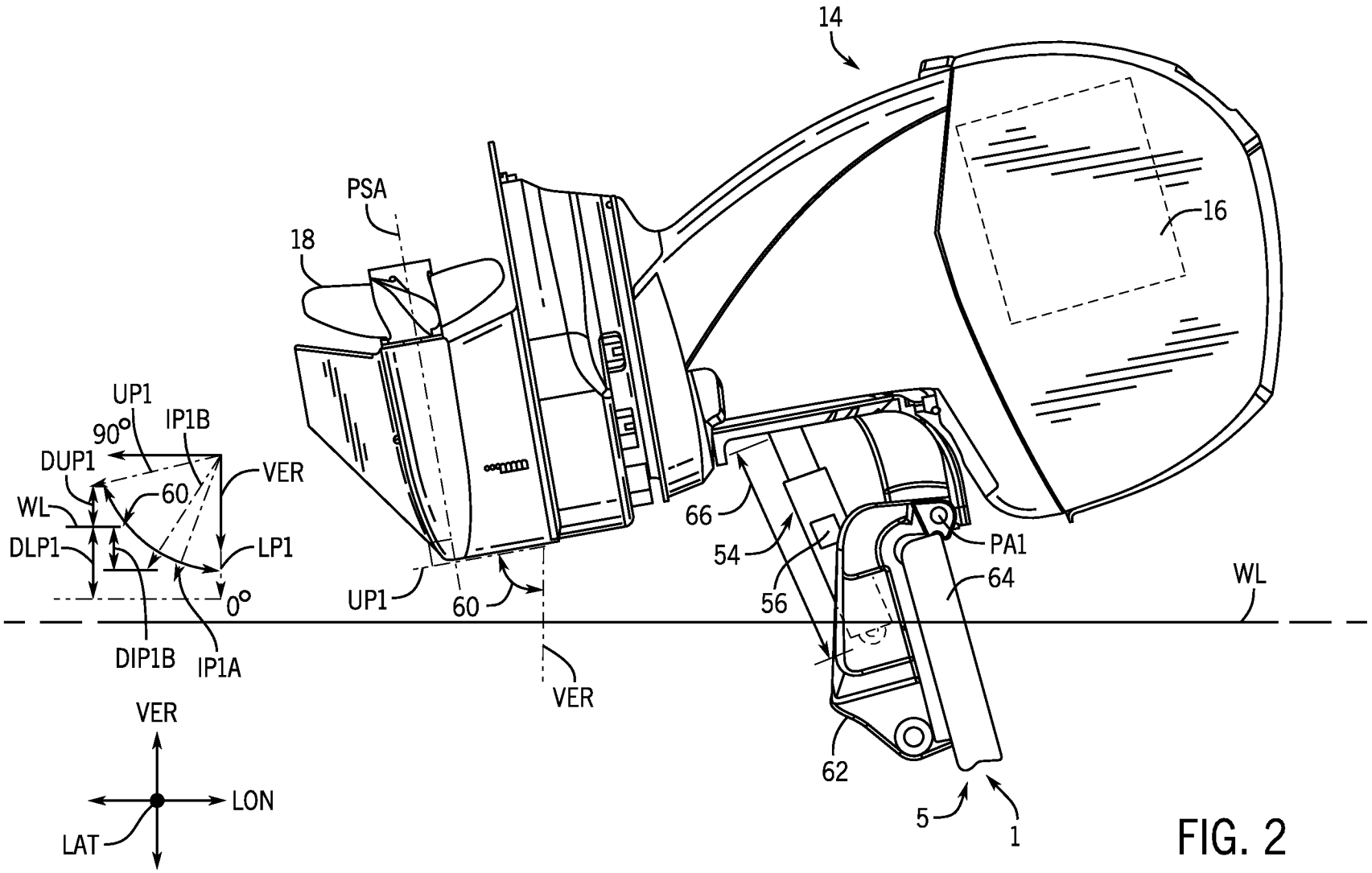
FIG. 2 is a right side view of an exemplary first marine drive such as may be incorporated with the marine vessel of FIG. 1.

Referring to FIGS. 1 and 2, the central control module 28 and/or propulsion control modules 29 also communicates with a trim actuator 54 associated with the first marine drive 14. As shown, the first marine drive 14 is coupled via a transom bracket 62 to the transom 64 at the stern 5 of the marine vessel 1. The transom bracket 62 allows the first marine drive 14 to pivot relative to the transom 64, and thus relative to the vertical axis VER, about a pivot axis PA1. Operating the trim actuator 54 changes a length 66 between opposing ends of the trim actuator 54. Changing the length 66 of the trim actuator 54 causes the first marine drive 14 to pivot about the pivot axis PA1 to thereby adjust the trim angle 60 of the first marine drive 14. The trim angle 60 can be changed to position the first marine drive 14 into and between a lower position LP1 and an upper position UP1 (or "fully trimmed" position) as well as a plurality of intermediate positions therebetween (e.g., IP1A, IP1B, etc.). In certain configurations, the upper position UP1 corresponds to a trim angle 60 of between 60 and 80 degrees and the lower position LP1 corresponds to a trim angle 60 of between +10 degrees. The propulsor 136 may be mostly or entirely out of the water when in the upper position UP1. The propulsor 136 is configured to propel the marine vessel 1 in the water when in the lower position LP1 and one or more of the intermediate positions (e.g., IP1A, IP1B) between the lower position LP1 and the upper position UP1. FIG. 2 shows the first marine drive 14 in the upper position UP1 with a trim angle 60 of approximately 75 degrees relative to the vertical axis VER.

It should be recognized that changing the trim angle 60 changes the depth of the first marine drive 14 within the water. In certain configurations, the lower position LP1 corresponds to the deepest depth of the first marine drive 14 and the upper position UP1 corresponds to the shallowest depth (or the greatest height above the water line, depending on the configuration). In particular, FIG. 2 shows the first marine drive 14 (e.g., at the propeller shaft axis PSA) having an upper position depth DUP1 at the upper position UP1, a lower position depth DLP1 at the lower position LP1, and a second intermediate depth DIP1B at the second intermediate position IP1B. It should be recognized that the depth of the first marine drive 14 at the second intermediate position IP1B (second intermediate depth DIP1B) is less than the depth at the lower position LP1 (lower position depth DLP1) and greater than the depth at the upper position UP1 (upper position depth DUP1, which in this case is above the waterline WL). It should further be recognized that while the present disclosure principally refers to embodiments in which the depth is changed via pivoting, other configurations are also contemplated. By way of example, this includes transom jack plates for moving the propeller 18 straight up and down (i.e., parallel to the vertical direction VER) via rack and pinion or other mechanisms known in the art.

Feedback regarding the trim angle 60 of the first marine drive 14 is provided via a trim angle sensor 56. The trim actuator 54 may be of a type presently known in the art. Additional information regarding exemplary trim actuators 54 and trim angle sensors 56 is provided in U.S. Pat. Nos. 6,583,728; 7,156,709; 7,416,456; and 9,359,057, which are incorporated by reference in entirety herein. The trim angle 60 is adjustable via trim commands that may be provided by the control system 200 discussed below. By way of example, these trim commands may be provided via auto-trim functions described in the U.S. Patents listed in the BACKGROUND section above, and/or by user input, such as through trim switches 68 or a user interface 36 at a helm 32 of the marine vessel 1.

With continued reference to FIGS. 1 and 2, the marine vessel 1 includes a number of operator input devices located at the helm 32 of the marine vessel 1, which may be used to control the first marine drive 14, the second marine drive 100, and/or other components of the marine vessel 1. The operator input devices include a multi-functional display device 34 with a user interface 36. The user interface 36 may be an interactive, touch-capable display screen, a keypad, a display screen and keypad combination, a track ball and display screen combination, or any other type of user interface known to those having ordinary skill in the art for communicating with a multi-functional display device 34. The operator input devices further include one or more steering devices, such as a steering wheel 40 and/or a joystick 38, configured to facilitate user input to control the system 10, and thus to steer the vessel 12. In the embodiment shown, a joystick 38 provided at the helm 32 allows an operator of the marine vessel 1 to command the marine vessel 1 to translate or rotate in any number of directions. The joystick 38 may be used to control one or both of the first marine drive 14 and the second marine drive 100 at the same time.

A steering wheel 40 is configured for providing steering commands to the first marine drive 14 and/or the second marine drive 100. It should be recognized that the steering wheel 40 or other steering devices (e.g., joystick 38, station-keeping functions, or auto-pilot functions) control steering for the marine vessel 1 via control of the steering actuators 50 discussed above. A throttle lever 42 is also configured for the user to provide thrust commands, including both a magnitude and a direction of thrust, to the central control module 28. The throttle lever 42 may be used to control the thrust for the first marine drive 14 and/or the second marine drive 100. When the throttle lever 42 is configured to control both marine drives, it may be further configured to do so one at a time and/or simultaneously. In certain embodiments, the thrust of the first marine drive 14 and/or the second marine drive 100 may also or alternatively be controlled by the joystick 38, by station-keeping and/or auto-pilot functions, and/or other mechanisms known in the art.

In this manner, several of the operator input devices at the helm 32 can be used to input an operator command for the powerhead 16 to the central control module 28, including the user interface 36 of the multi-functional display device 34, the joystick 38, and the throttle lever 42. By way of example, a rotation of the throttle lever 42 in a forward direction away from its neutral, detent position could be interpreted as a value from 0% to 100% operator demand corresponding via an input/output map, such as a look up table, to a position of the throttle valves or a setpoint for controlling the electrical power drawn by the powerhead 16. For example, the input/output map might dictate that the throttle valves are fully closed when the throttle lever 42 is in the forward, detent position (i.e., 0% demand), and are fully open when the throttle lever 42 is pushed forward to its furthest extent (i.e., 100% demand). As discussed further below, similar methods may also be employed for controlling steering, whereby operator inputs are received from a range of −100% to +100% corresponding to full port and full starboard steering directions, which then cause corresponding steering of the first marine drive 14 and/or the second marine drive 100, in certain examples through the use of a lookup table.

With continued reference to FIG. 1, the marine vessel 1 also includes a global positioning system (GPS) 30 that provides location and speed of the marine vessel 1 to the central control module 28. Additionally, or alternatively, a vessel speed sensor such as a Pitot tube or a paddle wheel could be provided. The marine vessel 1 may also include an inertial measurement unit (IMU) or an attitude and heading reference system (AHRS) 26. An IMU has a solid state, rate gyro electronic compass that indicates the vessel heading and solid state accelerometers and angular rate sensors that sense the vessel's attitude and rate of turn. An AHRS provides 3D orientation of the marine vessel 1 by integrating gyroscopic measurements, accelerometer data, and magnetometer data. The IMU/AHRS could be GPS-enabled, in which case a separate GPS 30 may not be required.

Figure 3:
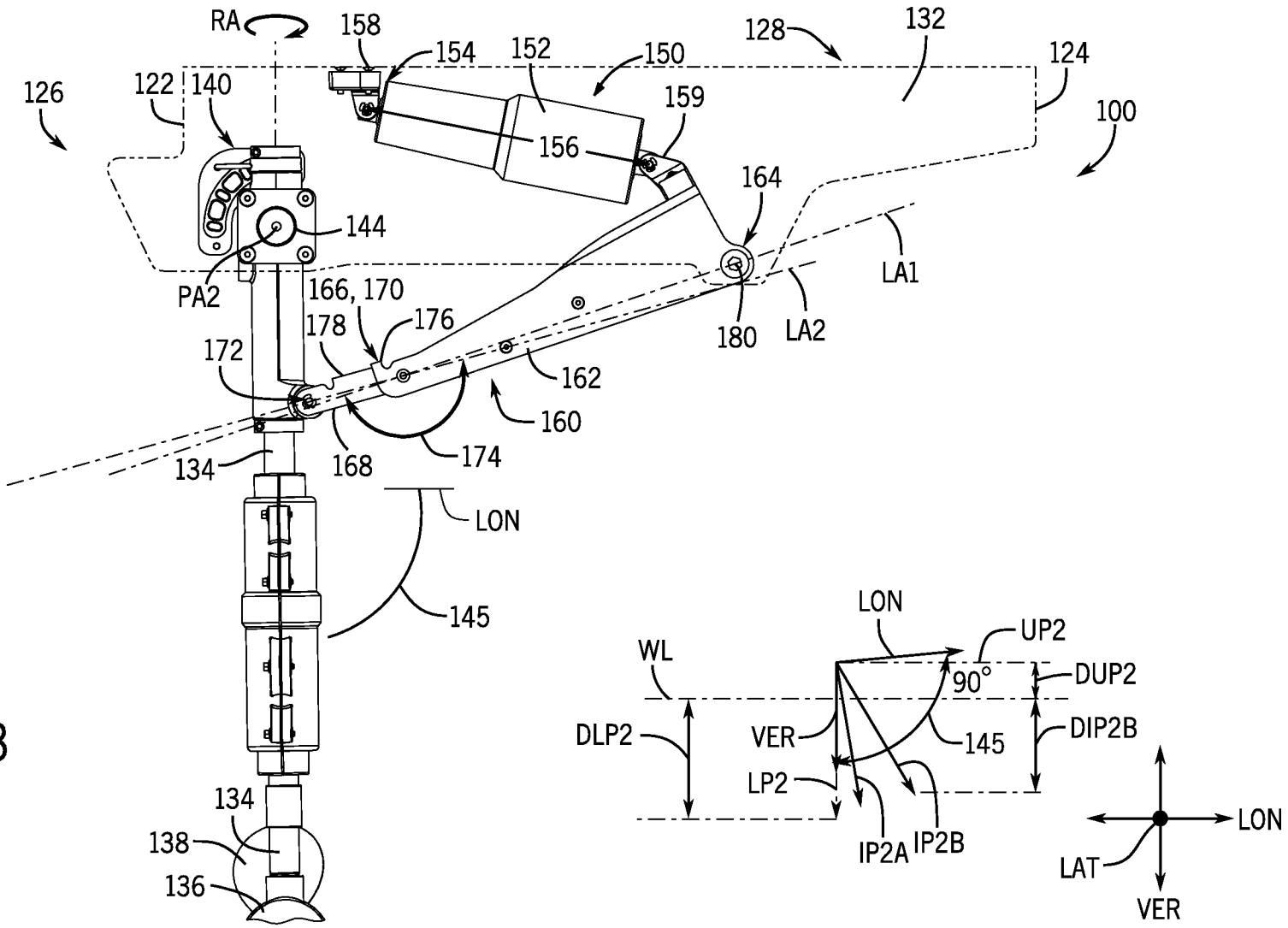
FIG. 3 is a right side view of a second marine drive such as may be incorporated with the marine vessel of FIG. 1, the second marine drive being shown in a lower position.
Figure 4:
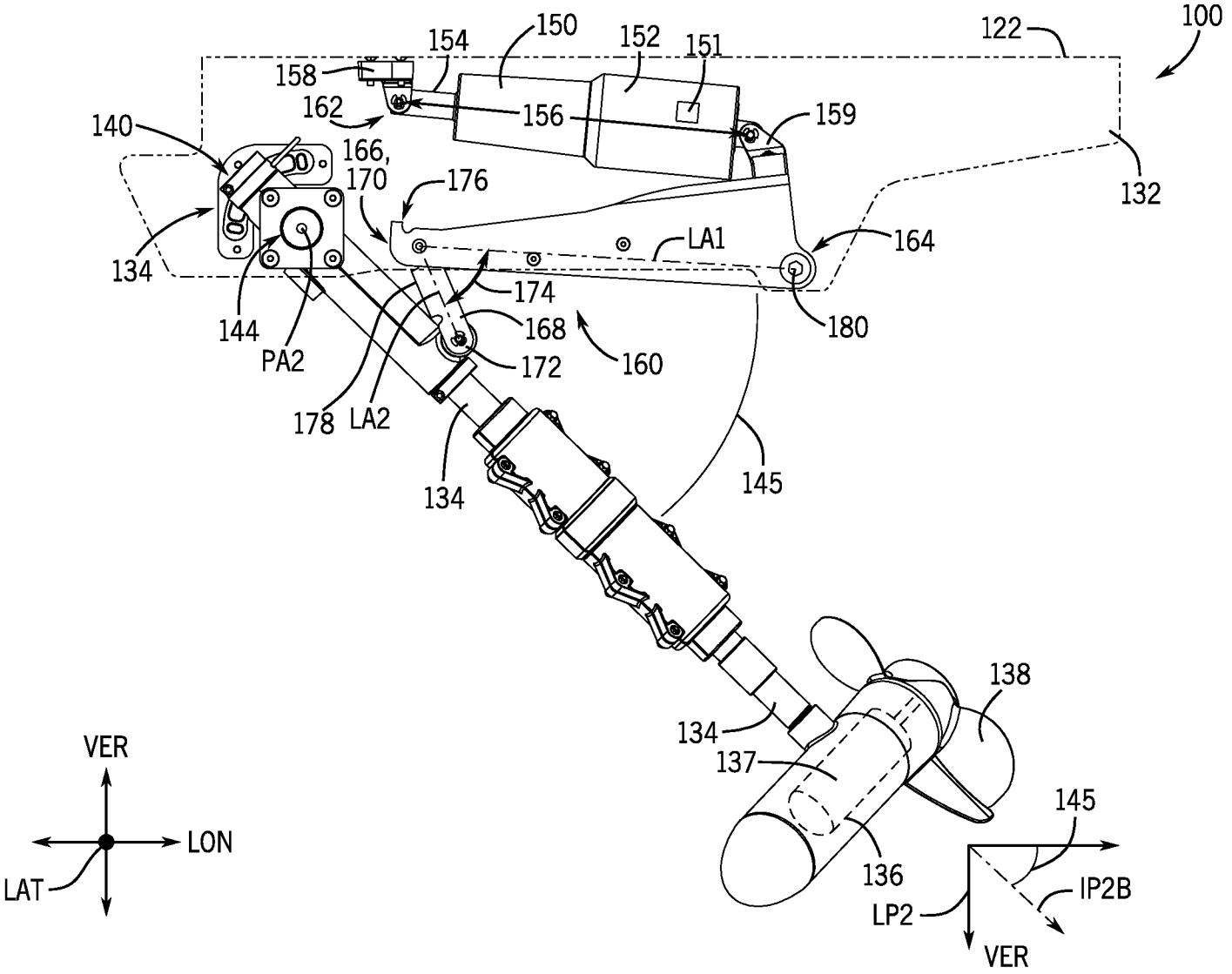
FIG. 4 is a right side view showing the second marine drive of FIG. 3 in an intermediate position.

With reference to FIGS. 3 and 4, additional information is now provided for the exemplary second marine drive 100, which is also referred to as a deployable thruster or a stowable thruster. The second marine drive 100 is coupled to the underside of the deck 2 between the pontoons 3 (FIG. 1). The second marine drive 100 includes a base 122 that extends between a front 124 and a back 126, a top 128 and a bottom 130, and sides 132. The second marine drive 100 includes a propulsor 136 that is configured to propel the marine vessel 1, such as via a motor drive 137 (e.g., an electric motor and other electronic components for powering and driving the electric motor as are conventional) rotating a propeller 138 in a customary manner. Additional information regarding the exemplary configurations for the base 122, the propulsor 136, and other aspects of the second marine drive 100 is also provided in U.S. Pat. No. 11,572,146 and U.S. Patent Pub. No. 2022/0266972, which are incorporated by reference in entirety herein.

The second marine drive 100 has an arm 134 that pivotably couples to the propulsor 136 to the base 122 via an axle 144 that extends between the sides 132 of the base 122. The propulsor 136 is pivotable via the arm 134 about a pivot axis PA2 into and between a lower position LP2 (or "fully deployed" position, shown in FIG. 3) and an upper position UP2 (or "fully stowed" position in which the propulsor 136 is nearest to the deck of the marine vessel), as well as a plurality of intermediate positions therebetween (e.g., IP2A, IP2B, etc.). The propulsor 136 may be characterized as having a pivot angle 145 relative to the horizontal axis or plane (e.g., thus being parallel to the longitudinal axis LON). By way of non-limiting example, the upper position UP2 may have a pivot angle 145 between 0 and 10 degrees and the lower position LP2 may have a pivot angle 145 between 85 and 95 degrees. The propulsor 136 may be mostly or entirely out of the water when in the upper position UP2, depending on the side of the propulsor 136, the second marine drive 100 generally, and the height of the underside of the deck of the marine vessel above the waterline WL. The propulsor 136 is configured to propel the marine vessel 1 in the water when in the lower position LP2 and one or more of the intermediate positions (e.g., IP2A) between the lower position LP2 and the upper position UP2. FIG. 4 shows the propulsor 136 in a second intermediate position IP2B that has a pivot angle 145 of approximately 60 degrees relative to the longitudinal axis LON.

In this manner, it should be recognized that the propulsor 136 is not only stowed and deployed by pivoting the arm 134, but this pivoting also controls the depth of the propulsor 136 in the water (e.g., below the waterline WL of FIG. 1). In particular, the propulsor 136 has a lower position depth DLP2 at the lower position LP2 and a second intermediate depth DIP2B at the second intermediate position IP2B (see FIG. 3). The second intermediate depth DIP2B at the second intermediate position IP2B is shallower than the lower position depth DLP2 at the lower position LP2. It should further be recognized that while the present disclosure principally refers to embodiments in which the depth of the propulsor 136 is changed via pivoting, other configurations are also contemplated. By way of example, this includes moving the propulsor straight up and down (i.e., parallel to the vertical direction VER) via rack and pinion, a scissor-type lift, or other mechanisms known in the art. For simplicity, changing the angle or depth of the propulsor 136 may also be referred to as changing the depth of the second marine drive 100 generally.

In the illustrated configuration of FIGS. 3 and 4, a gearset 140 is also operatively coupled between the arm 134 and the base 122. The gearset 140 provides for rotation of the arm 134 about its length (rotation axis RA) as the arm 134 is pivoted about the axle 144 between the upper position UP2 and the lower position LP1. Additional information regarding the exemplary configurations of gearsets 140 is provided in U.S. patent application Ser. No. 17/185,289. While there are advantages to rotating the propulsor 136, the present disclosure also contemplates configurations in which the second marine drive 100 does not provide for rotating the propulsor 136 as it pivots into and between the upper position UP2 to the lower position LP2.

The arm 134 may be pivoted into and between the upper position UP2 and the lower position LP2 via an actuator 150, shown here to be a linear actuator of a type presently known in the art. The actuator 150 has a cylinder 152 that receives a rod 154 therein. The actuator 150 may be actuated hydraulically, pneumatically, and/or electro-mechanically to extend and retract the rod 154 within the cylinder 152, thereby changing a length 156 between opposing ends of the actuator 150. In certain configurations, the actuator 150 includes a sensor 151 (e.g., an encoder or string potentiometer, or other position sensor known in the art) that measures a position of the rod 154 relative to the cylinder 152 to determine the length 156 between opposing ends of the actuator 150 at any given time. Additional information regarding the examples for the base actuator 150 and how it may cause the arm 134 and the propulsor 136 to pivot are also provided in U.S. Pat. No. 11,572,146 and U.S. Patent App. Pub. No. 2022/0266972, as discussed above.

With continued reference to FIGS. 3 and 4, the rod 154 of the actuator 150 is pivotally coupled to the base 122 via a clevis bracket 158 using methods known in the art, such as through welds, fasteners, and/or the like. At an opposite end of the actuator 150, the cylinder 152 is pivotally coupled to an actuator linkage 160 that couples the actuator 150 to the arm 134 to provide pivoting thereof about the axle 144. The actuator linkage 160 includes a first link 162 that extends between a first end 164 and a second end 166 defining a length LA1 therebetween, as well as a second link 168 that extends between a first end 170 and a second end 172 defining a length LA2 therebetween. The first end 164 of the first link 162 is pivotally coupled to the side 132 of the base 122 of the second marine drive 100. The actuator 150 is also coupled to this first link 162, particularly via another clevis bracket 159 that is offset from the pivotal connection of the first link 162 to the sides 132 of the base 122.

The second end 166 of the first link 162 is pivotally coupled to the first end 170 of the second link 168. The second end 172 of the second link 168 is pivotally coupled to the arm 134 supporting the propulsor 136. The pivotal connections within the actuator linkage 160 may be made through methods known in the art, such as the use of bolts, pins, rivets, and/or other fasteners. It should be recognized that the first link 162 and/or the second link 168 may be comprised of one or more parallel members for stability and to prevent twisting in use.

The illustrated configuration, the pivot angle 174 between the first link 162 and the second link 168 is limited by a stop finger 176 coupled to the first link 162 engaging an edge 178 of the second link 168. The stop finger 176 may be provided via integral formation, bending, welding, fasteners, or other methods known in the art. In certain configurations, the stop finger 176 limits the pivot angle 174 between the first link 162 and the second link 168 to being between 160 and 190 degrees relative to each other. It may be particularly advantageous for the stop finger 176 to engage the edge 178 of the second link 168 at a pivot angle 174 of greater than 180 degrees when the propulsor 136 is in the lower position LP2. In particular, by configuring the actuator linkage 160 to be "over-center" (the pivot angle 174 exceeding 180 degrees), any forces exerted on the propulsor 136 or arm 134 are transferred to the contact between the stop finger 176 and the second link 168, and thus cannot be transferred to the actuator 150. This effectively locks the second marine drive 100 in the lower position LP2 (or deployed position) until the actuator 150 moves the actuator linkage 160 in an opposite direction to pivot the propulsor 136 towards the upper position UP (or stowed position).

With continued reference to FIGS. 3 and 4, further details are now provided for how the actuator 150 changes the depth of the propulsor 136, such as by moving from the upper position UP2 towards the lower position LP2. In the configuration shown, retraction of the actuator 150 (reducing the length 156 thereof) causes the actuator linkage 160 to cause the arm 134 to pivot about the axle 144 towards the deployed position. In particular, the actuator 150 causes the first link 162 to pivot about a pivot axis 180 near the first end 164 of the first link 162 (here, counter-clockwise) such that the second end 166 of the first link 162 moves downwardly, away from the base 122. The process is assisted by gravity, which provides a constant downward force on the mass of the actuator linkage 160 itself, as well as on the masses of the actuator 150 and the propulsor 136 coupled to the actuator linkage 160. It should be recognized that the actuator 150 may be positioned other than as shown, including being positioned such that extension (rather than retraction) causes rotation of the arm 134 towards the lower position LP2.

Rotation of the first link 162 allows the arm 134 to pivot downwardly towards the lower position LP2 (here, clockwise about the axle 144), supported by the second link 168 connected to the first link 162. For the configuration shown, the pivot angle 174 between the first link 162 and the second link 168 begins at less than 180 degrees (and here less than 90 degrees) when in the upper position UP2 (which is also true in the intermediate position IP2B of FIG. 4). For example, the pivot angle 174 may be 30 degrees, 45 degrees, or other angles below 180 degrees when in the upper position UP2. As the arm 134 pivots towards the lower position Lp2, the pivot angle 174 increases to be 180 degrees when the propulsor 136 is nearly in the lower position LP2 (the arm 134 extending nearly vertically downwardly).

Other mechanisms for changing the depth of the second marine device 14 relative to the water level WL are also contemplated. By way of example, this includes rotating the axle 144 coupled to the arm 134 via a rotary actuator, whereby in certain configurations the axle 144 is the shaft of the rotary actuator itself. An actuator linkage such as the actuator linkage 160 may still be incorporated for stability and support, or omitted.

In certain embodiments, the second marine drive 100 is steerable via a steering actuator 182 (FIG. 5) having a steering angle sensor 184, which may be the same or similar to the steering actuator 50 and steering angle actuator 52 discussed above with respect to the first marine drive 14. It should be recognized that just as the second marine drive 100 may be steerable, the first marine drive 14 need not be.

Figure 5:
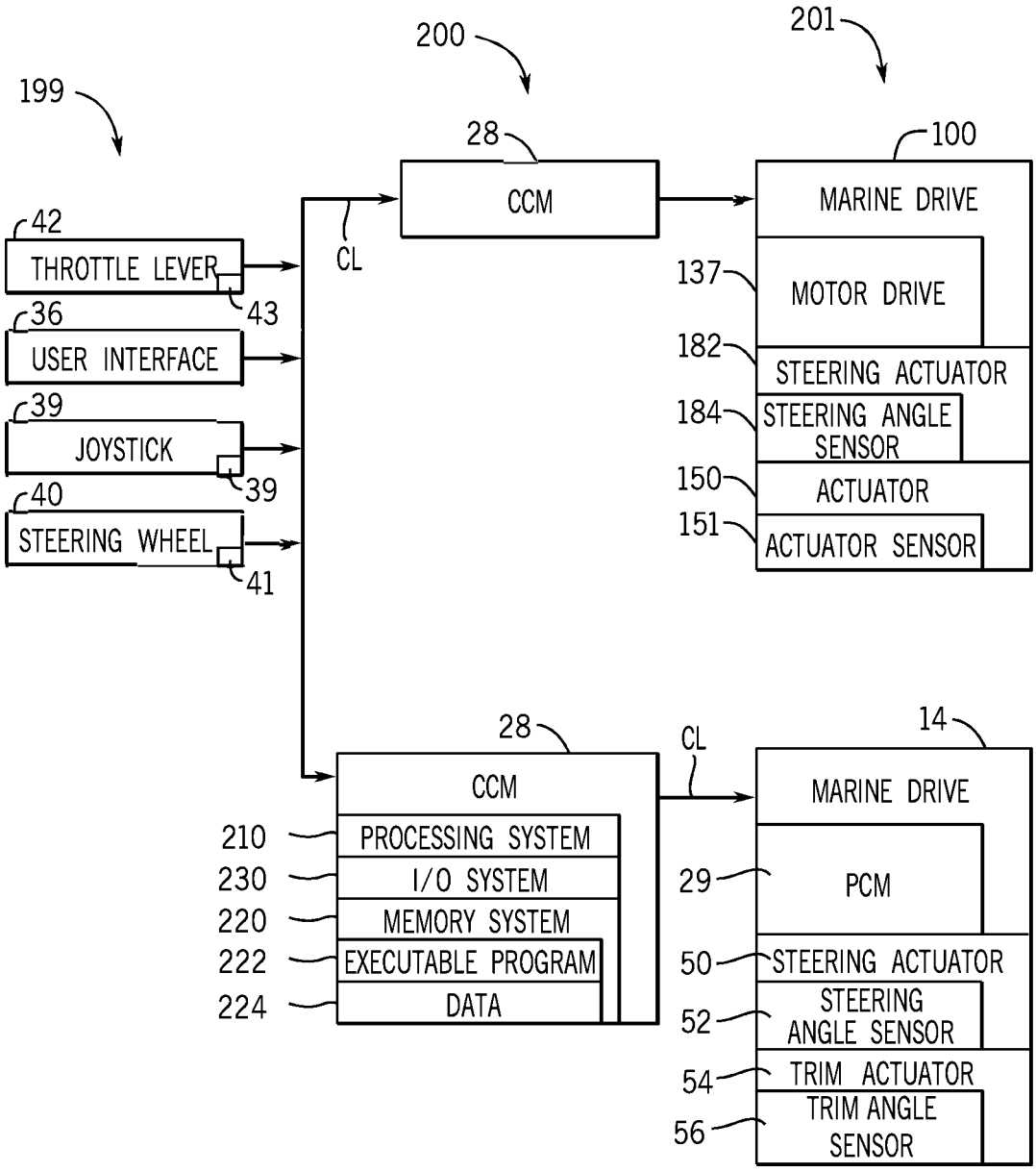
FIG. 5 is schematic view of a control system such as may be incorporated within the marine vessel of FIG. 1.

Additional information is now provided for subsystems within an exemplary central control module 28 for controlling the first marine drive 14 and/or the second marine drive 100, as shown in FIG. 5. A person of ordinary skill in the art will recognize that these subsystems may also be present within additional central control modules 28 (as applicable), and/or propulsion control modules 29 or other controllers within the marine vessel 1. In the illustrated control system 200, the central control module 28 includes a processing system 210, which may be implemented as a single microprocessor or other circuitry, or be distributed across multiple processing devices or sub-systems that cooperate to execute the executable program 222 from the memory system 220. Non-limiting examples of the processing system include general purpose central processing units, application specific processors, and logic devices. In the example shown, two central control modules 28 associated with the first marine drive 14 and the second marine drive 100 together comprise a control system 200. However, as discussed above, the propulsion control module 29 and/or other controllers in alternate configurations may also be considered to be part of the control system 200.

The central control module 28 further includes a memory system 220, which may comprise any storage media readable by the processing system 210 and capable of storing the executable program 222 and/or data 224. The memory system 220 may be implemented as a single storage device, or be distributed across multiple storage devices or subsystems that cooperate to store computer readable instructions, data structures, program modules, or other data. The memory system 220 may include volatile and/or non-volatile systems, and may include removable and/or non-removable media implemented in any method or technology for storage of information. The storage media may include non-transitory and/or transitory storage media, including random access memory, read only memory, magnetic discs, optical discs, flash memory, virtual memory, and non-virtual memory, magnetic storage devices, or any other medium which can be used to store information and be accessed by an instruction execution system, for example. An input/output (I/O) system 230 provides communication between the control system 200 and peripheral devices, such as input devices 199 and output devices 201, which are discussed further below. In practice, the processing system 210 loads and executes an executable program 222 from the memory system 220, accesses data 224 stored within the memory system 220, and directs the system 10 to operate as described in further detail below.

A person of ordinary skill in the art will recognize that these subsystems within the control system 200 may be implemented in hardware and/or software that carries out a programmed set of instructions. As used herein, the term "central control module" may refer to, be part of, or include an application specific integrated circuit (ASIC); an electronic circuit; a combinational logic circuit; a field programmable gate array (FPGA); a processor (shared, dedicated, or group) that executes code; other suitable components that provide the described functionality; or a combination of some or all of the above, such as in a system-on-chip (SoC). A central control module may include memory (shared, dedicated, or group) that stores code executed by the processing system. The term "code" may include software, firmware, and/or microcode, and may refer to programs, routines, functions, classes, and/or objects. The term "shared" means that some or all code from multiple central control modules may be executed using a single (shared) processor. In addition, some or all code from multiple central control modules may be stored by a single (shared) memory. The term "group" means that some or all code from a single central control module may be executed using a group of processors. In addition, some or all code from a single central control module may be stored using a group of memories. As shown in FIG. 5, one or more central control module 28 may together constitute a control system 200. The one or more central control modules 28 can be located anywhere on the marine vessel 1.

A person of ordinary skill in the art will understand in light of the disclosure that the control system 200 may include a differing set of one or more control modules, or control devices, which may include engine control modules (ECMs) for the first marine drive 14 and/or the second marine drive 100 (which may be referred to as ECMs even if the corresponding marine drive contains an electric motor in addition to or in place of an internal combustion engine), one or more thrust vector control modules (TVMs), one or more helm control modules (HCMs), and/or the like. Likewise, certain aspects of the present disclosure are described or depicted as functional and/or logical block components or processing steps, which may be performed by any number of hardware, software, and/or firmware components configured to perform the specified functions. For example, certain embodiments employ integrated circuit components, such as memory elements, digital signal processing elements, logic elements, look-up tables, or the like, configured to carry out a variety of functions under the control of one or more processors or other control devices.

The control system 200 communicates with each of the one or more components of the marine vessel 1 via a communication link CL, which can be any wired or wireless link. The illustrated communication link CL connections between functional and logical block components are merely exemplary, which may be direct or indirect, and may follow alternate pathways. The control system 200 is capable of receiving information and/or controlling one or more operational characteristics of the marine vessel 1 and its various sub-systems by sending and receiving control signals via the communication links CL. In one example, the communication link CL is a controller area network (CAN) bus; however, other types of links could be used. It will be recognized that the extent of connections and the communication links CL may in fact be one or more shared connections, or links, among some or all of the components in the marine vessel 1. Moreover, the communication link CL lines are meant only to demonstrate that the various control elements are capable of communicating with one another, and do not represent actual wiring connections between the various elements, nor do they represent the only paths of communication between the elements. Additionally, the marine vessel 1 may incorporate various types of communication devices and systems, and thus the illustrated communication links CL may in fact represent various different types of wireless and/or wired data communication systems.

With continued reference to FIG. 5, the control system 200 communicates with input devices 199 from various components such as the joystick 38 (FIG. 1) or a steering wheel 40 discussed above, in particular via the sensor 39 or the sensor 41 corresponding thereto, respectively. The control system 200 also communicates with other operator input devices, such as the throttle lever 42 via its sensor 43, or the user interface 36, such as by setting a route or destination using the GPS 30 or other systems discussed above. The control system 200 also communicates with output devices 201 such as the propulsion control module 29, the steering actuator 50, and the trim actuator 54 discussed above. It will be recognized that the arrows shown are merely exemplary and that communication may flow in multiple directions. For example, the steering angle sensors 52, 184, the trim angle sensor 56, and the sensor 151, while shown as corresponding to the steering actuators 50, 182, the trim actuator 54, and the actuator 150, may serve as input devices 199 feeding into the one or more central command modules 28.

Although FIG. 1 showed one central control module 28, it will be recognized that more than one central control module may work together serially and/or in parallel, such as one central control module for each of the marine drives as shown in FIG. 5. Portions of the methods disclosed herein below can be carried out by a single central control module or by several separate control modules communicatively connected and cooperating to provide steering and propulsion control for the marine vessel 1, such as based on user input at a steering device 38, 40 at the helm 32. For example, the one or more central control module 28 may be communicatively connected to a propulsion control module 29 associated with each of the first marine drive 14 and the second marine drive 100. If more than one central control module is provided, each can control operation of a specific device or sub-system on the marine vessel.

Through experimentation and development, the present inventors have recognized issues with stowable thrusters known in the art, including those used as bow thrusters near the bow of a marine vessel or as stern thrusters near the stern of a marine vessel. Stowable thrusters known in the art have only a single deployment setpoint. The thruster is either stowed (unable to propel the marine vessel), or fully deployed. This is particularly problematic when the marine vessel is operated in shallow water or near underwater obstacles such as trailer or shore station bunks. In these situations, it is possible to trim up a conventional primary marine drive, such as an outboard or sterndrive motor, to avoid contacting the ground and thus damaging the marine drive. However, as stated above, no depth-based accommodations can be made for the conventional thruster, which is either fully stowed or fully deployed.

For simplicity, the stowable thruster is referred to herein as the second marine drive, whereas the primary marine drive (e.g., a sterndrive or an outboard) is referred to as the first marine drive. The present inventors have developed the presently disclosed systems 10 and methods for controlling the first marine drive and the second marine drive to prevent this damage to thrusters when situated in shallow water and/or near underwater obstacles. With reference to FIG. 5 and the components discussed above, in certain configurations the control system 200 is configured to change the depth of the second marine drive 100 via the second actuator 150 based on the trim angle 60 (FIG. 2) of the first marine drive 14 to prevent damage to the second marine drive 100. Explained in another manner, the system 10 provides for deploying the second marine drive 100 to a depth other than simply the lower position LP2 (the deepest or "fully deployed" position, FIGS. 3 and 4), here on the basis of the trim angle 60 of the first marine drive 14. This ensures that whenever the trim angle 60 of the first marine drive 14 is adjusted to protect the first marine drive 14, the second marine drive 100 is correspondingly protected. As discussed above, the trim angle 60 may be adjusted in accordance with trim commands provided by the user (e.g., via trim switches 68 or a user interface 36 at a helm 32 of the marine vessel 1 as shown in FIG. 1), and/or via the control system 200 itself (e.g., auto-trim functions).

In certain embodiments, a lookup table and/or algorithm is stored within the data 224 in the memory system 220 of the control system 200. The trim angle 60 of the first marine drive 14, as read by the trim angle sensor 56, is an input to the lookup table and/or algorithm. The control system 200 then determines the corresponding maximum depth for positioning the second marine drive 100 based on the lookup table and/or algorithm. In other words, the lookup table, algorithm, or other control mechanism stored in the data 224 determines the deepest allowable position for the second marine drive 100 as a function of the trim angle 60 of the first marine drive 14, though other factors may modify this maximum depth and/or the maximum depth may be overridable by the user. As discussed above, the deepest allowable position for deploying the second marine drive 100 need not always correspond to its lowest position LP2, which is the setpoint for fully deploying the second marine drive 100 if there are no concerns with water depth.

The maximum depth may be represented as the pivot angle 145 of the arm 134 supporting the propulsor 136 of the second marine drive 100, particularly in configurations in which the depth is adjusted by pivoting the arm 134 to change the depth of the propulsor 136. The control system 200 then controls the second actuator 150 as needed such that the depth of the second marine drive 100 does not exceed that maximum depth. By way of example, increasing the trim angle 60 of the first marine drive 14 by 1 degree may cause the second actuator 150 to decrease the pivot angle 145 of the propulsor 136 for the second marine drive 100 by 1 degree, 2 degrees, 0.5 degrees, or other ratios or multipliers. It should be recognized that the relationship between increasing the trim angle 60 of the first marine drive 14 and the pivot angle 145 for the second marine drive 100 may depend upon the lengths of the corresponding marine drives, the height in which each is positioned and/or pivotable above the waterline WL, and the like.

In certain configurations, trim thresholds are employed such that not every change to the trim angle 60 of the first marine drive 100 need cause a change in the pivot angle 145 of the second marine drive 100. The present inventors have recognized that this avoids unnecessary overuse of the second actuator 150, as well as the additional noise, harshness, and/or vibration of operating the second actuator 150 when adjustment to the depth of the second marine drive 100 is not needed.

In one example, an intermediate position is selected as the trim threshold (e.g., the first intermediate position IP1A shown in FIG. 2) for the first marine drive 14 is stored in the memory system 220 of the control system 200 for subsequent access and comparison. By way of example, the trim threshold may be 20 degrees relative to the vertical axis VER. Other trim thresholds may include 10, 30, or 45 degrees. The control system 200 is configured to access the stored trim threshold, compare the trim angle of the first marine drive 14 to the trim threshold, and to change the depth of the second marine drive 100 based on the trim angle 60 of the first marine drive 14 only when the trim angle 60 of the first marine drive is at or above this intermediate position (IP1A). In other words, in the illustrated example the control system 200 changes the depth of the second marine drive 100 only when the trim angle of the first marine drive 14 is determined to be between the intermediate position (the trim threshold) and the upper position UP1. This provides that the depth of the second marine drive 100 is not changed, at least on the basis of the trim angle of the first marine drive changing, until the depth of the first marine drive 14 (via the trim angle 60 thereof) has been increased enough from the lower position LP.

In a further example, the control system 200 is further configured such that the pivot angle 145 of the second marine drive 100 is decreased again (e.g., is moved to its lower position LP2) once the trim angle 60 of the first marine drive 14 is again less than the trim threshold. In this manner, the control of the second marine drive 100 automatically restores the fully deployed position thereof once the risk of damage is deemed to be resolved. It should be recognized that the control system 200 may compare the trim angle of the first marine drive and/or the pivot angle of the second marine drive to multiple thresholds to accomplish the different functions described herein.

Certain embodiments may also provide for a minimum depth threshold to be determined for the second marine drive 100 via a lookup table, algorithm, or other mechanism. The minimum depth threshold is the minimum depth for deploying the second marine drive 100 so as to be able to propel the marine vessel in the water. By way of example the minimum depth may be set to correspond to the center of the propeller being at least 6 inches below the waterline WL, determined by knowing the actual or nominal height for installing the second marine drive 100 on the underside of the marine vessel's deck, along with the pivot angle 145, the length of the arm 34, etc. If the maximum depth determined by the control system 200, based at least in part on the trim angle 60 of the first marine drive 14, is less than the minimum depth threshold, the second marine drive 100 is fully stowed or moved to another position (i.e., shallower than the maximum depth) rather than changing the depth to the maximum depth. For example, the second marine drive 100 may be caused to be fully stowed whenever the trim angle of the first marine drive 14 is 60 degrees or greater from the vertical axis VER. Alternatively, the control system 200 may move the second marine drive 100 to the minimum depth threshold when the first marine drive 14 is 60 degrees or greater from the vertical axis VER.

The present disclosure also contemplates configurations in which the depth of the second marine drive 100 is changeable manually, including to intermediate positions other than the upper position UP2 and the lower position LP2. The depth of the second marine drive 100 may be manually adjusted in accordance with depth commands provided by the user, such as via depth switches 69 or a user interface 36 at a helm 32 of the marine vessel 1 (FIG. 1). The depth command may be provided as an angle, a percentage, or a vertical distance. Additionally, the depth may be changed in accordance with other control parameters of the control system 200, for example based on depth charts stored in the memory system 220 in accordance with the location of the marine vessel 1 as determined by the GPS 30.

Likewise, a depth gauge 89 (e.g., a sonar sensors, FIG. 1) may be used to determine the depth of the marine vessel 1 and be used by the control system 200 to vary control of at least the second marine drive 100. For example, if the control system 200 determines that the depth of the water from the depth gauge 89 exceeds a minimum threshold (e.g., 10 feet), no adjustment to the depth of the second marine drive 100 is made even if the first marine drive 14 is trimmed up, recognizing that no damage will result to the second marine drive 100.

The control system 200 may also provide for other control of one marine drive as a function of the other. By way of example, this may include preventing the first marine drive 14 and the second marine drive 100 from simultaneously propelling the marine vessel 1 in the water. In certain examples, operating the first marine drive 14 to propel the marine vessel 1, which may be subject to a minimum speed threshold such as 5 MPH, may cause the second marine vessel 100 to automatically reduce depth, or to move entirely to the upper position UP2 (i.e., to be stowed).

In certain configurations, the system 10 may be operated according to different operating modes, which may be selectable at the helm 32. These operating modes may include "enabled" and "disabled" modes in which the second marine drive 100 is controlled and not controlled based on the trim angle of the first marine drive 14, respectively. Another operating mode (e.g., an "independent control") provides that the depth of the second marine drive 100 is controlled by the control system 200, but does not include the trim angle 60 of the first marine drive 14 as a basis for this control. For example, the depth of the second marine drive 100 in independent control mode is still controlled based on the readings of the depth gauge 88 and/or location of the marine vessel 1 from the GPS 30, but not controlled as a function of the first marine drive 14.

As discussed above the depth of the second marine drive 100 may also be manually controlled (e.g., via the depth controls 69 at the helm 32), including to override any of the other automated controls from the control system 200 discussed herein. Manual override may require the user to acknowledge the risks associated with manual control via prompts on the user interface 36 and/or may result in visual, audible, or tactile warnings. Similarly, visual, audible, or tactile notifications may be provided at the helm 32 when the depth of the second marine drive 100 is changed more generally.

In certain embodiments, the control system 200 is configured to provide these visual, audible, or tactile notifications to the user to accept a recommended change in the depth of the second marine drive 100 based on the trim angle of the first marine drive 14 and/or other factors as discussed herein above. In certain embodiments, these additional factors may include the detection of an object strike. For example, if the actuator of the second marine drive detects an object strike (e.g., via a sudden change in position other than via the movement of the actuator) may cause the depth of the second marine drive 100 to be reduced so as to avoid further object strikes. The control system 200 may then execute the change in depth of the second marine drive 100 upon acceptance by the user. Alternatively, the control system 200 may be configured such that the user adjusts the depth of the second marine drive 100 to meet the recommended change in depth, for example until the visual, audible, or tactile notifications provide that the depth of the second marine drive 100 has been appropriately changed.

Figure 6:
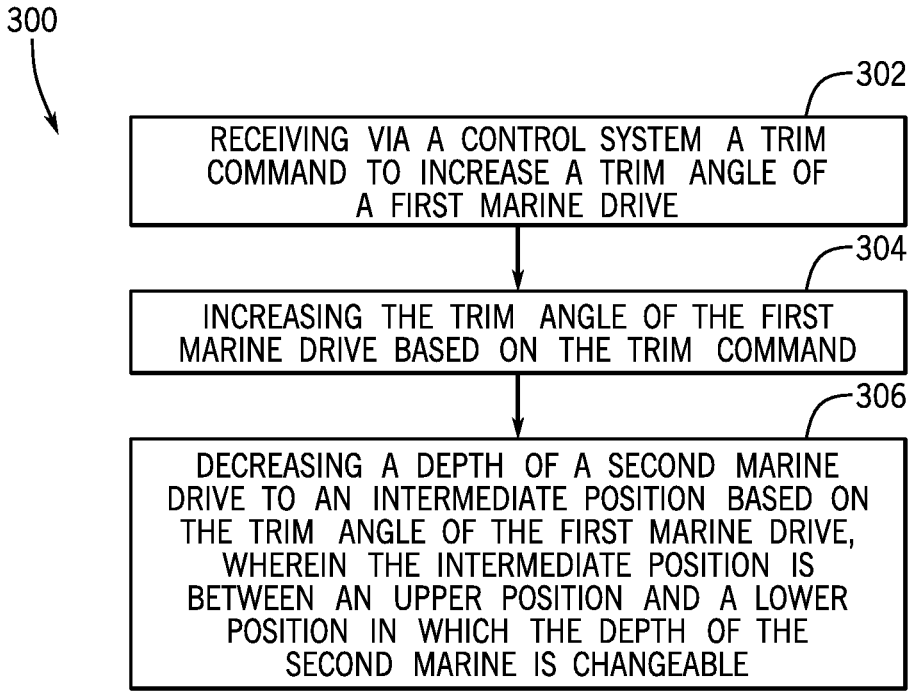
FIG. 6 is a flow chart of an exemplary method for controlling marine drives according to the present disclosure.

With concurrent reference to FIG. 1, FIG. 6 shows an exemplary method 300 for controlling marine drives according to the present disclosure, which includes some of the steps and involves some of the components discussed above. Step 302 provides for receiving via a control system a trim command to increase a trim angle of a first marine drive. As discussed above, the trim command may be received by trim switches 68 at the helm 32, auto-trim controls within the control system, and/or other mechanisms. Step 304 provides for increasing the trim angle of the first marine drive based on the trim command, which may be effectuated by control of an actuator such as the trim actuator 54 discussed above. Step 306 provides for decreasing a depth of a second marine drive to an intermediate position based the trim angle of the first marine drive. The intermediate position is between an upper position and a lower position in which the depth of the second marine drive is changeable. Additionally, the second marine drive is configured to propel the marine vessel in the water in the lower position as well as in the intermediate position.

As discussed above, changing the depth of the second marine drive may be effectuated via control of the actuator 150 (FIGS. 3-4) discussed above or other mechanisms known in the art. The mechanism for adjusting the depth of the second marine drive may vary depending on the configuration of the second marine drive. As discussed above, the second marine drive may be pivotable or be vertically translatable, or be depth-adjusted by other mechanisms such as a scissor-lift type connection between the propulsor of the second marine drive and the dec or hull of the marine vessel.

The functional block diagrams, operational sequences, and flow diagrams provided in the Figures are representative of exemplary architectures, environments, and methodologies for performing novel aspects of the disclosure. While, for purposes of simplicity of explanation, the methodologies included herein may be in the form of a functional diagram, operational sequence, or flow diagram, and may be described as a series of acts, it is to be understood and appreciated that the methodologies are not limited by the order of acts, as some acts may, in accordance therewith, occur in a different order and/or concurrently with other acts from that shown and described herein. For example, those skilled in the art will understand and appreciate that a methodology can alternatively be represented as a series of interrelated states or events, such as in a state diagram. Moreover, not all acts illustrated in a methodology may be required for a novel implementation.

This written description uses examples to disclose the invention, including the best mode, and also to enable any person skilled in the art to make and use the invention. Certain terms have been used for brevity, clarity, and understanding. No unnecessary limitations are to be inferred therefrom beyond the requirement of the prior art because such terms are used for descriptive purposes only and are intended to be broadly construed. The patentable scope of the invention is defined by the claims and may include other examples that occur to those skilled in the art. Such other examples are intended to be within the scope of the claims if they have features or structural elements that do not differ from the literal language of the claims, or if they include equivalent features or structural elements with insubstantial differences from the literal languages of the claims.

What is claimed is:

1. A marine vessel configured to be situated in water, the marine vessel comprising:

a first marine drive and a second marine drive each configured to propel the marine vessel in the water;

a first actuator configured to change a trim angle of the first marine drive in the water;

a second actuator configured to change a depth of the second marine drive in the water; and a control system operatively connected to the first actuator and the second actuator, wherein the control system is configured to change the depth of the second marine drive via the second actuator based on the trim angle of the first marine drive to prevent damage to the second marine drive.

2. The marine vessel according to claim 1, wherein the first marine drive comprises at least one outboard motor and the second marine drive comprises a stowable thruster.

3. The marine vessel according to claim 2, wherein the first marine drive is positioned near a stern of the marine vessel and the second marine drive is positioned near a bow of the marine vessel.

4. The marine vessel according to claim 1, wherein the control system is operably connected to the first marine drive and the second marine drive, and wherein the control system is configured to prevent the first marine drive and the second marine drive from simultaneously propelling the marine vessel.

5. The marine vessel according to claim 1, wherein the second actuator is configured to change the depth of the second marine drive to an upper position, a lower position that is deeper in the water than the upper position, and least one intermediate position therebetween.

6. The marine vessel according to claim 5, wherein the second marine drive is configured to propel the marine vessel in each of the lower position and the intermediate position.

7. The marine vessel according to claim 6, wherein the first actuator is configured to change the trim angle of the first marine drive to an upper position, a lower position, and an intermediate position therebetween.

8. The marine vessel according to claim 1, wherein the first actuator is configured to change the trim angle of the first marine drive to an upper position, a lower position, and an intermediate position therebetween, and wherein the control system is configured to change the depth of the second marine drive based on the trim angle of the first marine drive only when the trim angle of the first marine drive is at or between the intermediate position and the upper position.

9. The marine vessel according to claim 1, wherein the control system is configured to receive a trim command from a user to change the trim angle of the first marine drive.

10. The marine vessel according to claim 9, wherein the control system is configured to receive a depth command from the user to change the depth of the second marine drive.

11. The marine vessel according to claim 1, wherein the second actuator pivots the second marine drive to change the depth thereof.

12. The marine vessel according to claim 1, wherein the depth of the second marine drive is changeable into and between an upper position that is out of the water and a lower position that is in the water.

13. A method for changing via a control system a first marine drive and a second marine drive for a marine vessel configured to be situated in water, a trim angle of the first marine drive being changeable, and a depth of the second marine drive being changeable into and between an upper position and a lower position with intermediate positions therebetween, the method comprising:

receiving via the control system a trim command to increase the trim angle of the first marine drive;

increasing the trim angle of the first marine drive based on the trim command; and decreasing a depth of the second marine drive to one of the intermediate positions based on the trim angle of the first marine drive so as to prevent damage to the second marine drive.

14. The method according to claim 13, further comprising operating the second marine drive while in the one of the intermediate positions to propel the marine vessel.

15. The method according to claim 13, further comprising comparing the trim angle of the first marine drive to a trim threshold and decreasing the depth of the second marine drive based on the trim angle of the first marine drive only when the trim angle is greater than the trim threshold.

16. The method according to claim 15, further comprising increasing the depth of the second marine drive when the trim angle of the first marine drive is less than the trim threshold after being greater than the trim threshold.

17. The method according to claim 13, wherein the trim command is a first trim command, further comprising receiving a second trim command to decrease the trim angle of the first marine drive, decreasing the trim angle of the first marine drive based on the second trim command, and increasing the depth of the second marine drive based on the trim angle of the first marine drive.

18. The method according to claim 13, further comprising accessing a stored lookup table for changing the depth of the second marine drive based on the trim angle of the first marine drive when changing the depth of the second marine drive.

19. The method according to claim 13, wherein the trim angle of the first marine drive is changeable into and between an upper position and a lower position, further comprising changing the depth of the second marine drive to the upper position when the trim angle of the first marine drive is in the upper position.

20. The method according to claim 13, wherein the trim command is receivable from a user, and wherein the control system is further configured to receive a depth command for changing the depth of the second marine drive other than based on the trim angle of the first marine drive.

* * * * *